US007869736B2

(12) United States Patent
Inoue

(10) Patent No.: US 7,869,736 B2
(45) Date of Patent: Jan. 11, 2011

(54) TRANSFER UNIT AND IMAGE FORMING APPARATUS

(75) Inventor: Mutsumi Inoue, Osaka (JP)

(73) Assignee: Kyocera Mita Corporation (JP)

( * ) Notice: Subject to any disclaimer, the term of this patent is extended or adjusted under 35 U.S.C. 154(b) by 30 days.

(21) Appl. No.: 12/361,724

(22) Filed: Jan. 29, 2009

(65) Prior Publication Data

US 2009/0196649 A1 Aug. 6, 2009

(30) Foreign Application Priority Data

Jan. 31, 2008 (JP) ..... 2008-021352

(51) Int. Cl.
*G03G 15/16* (2006.01)
*G03G 21/10* (2006.01)

(52) U.S. Cl. ..... 399/101; 399/302

(58) Field of Classification Search ..... 399/101, 399/99, 71, 302, 308
See application file for complete search history.

(56) References Cited

U.S. PATENT DOCUMENTS

2007/0201898 A1* 8/2007 Mochizuki ..... 399/101
2007/0217813 A1* 9/2007 Miyamoto et al. ..... 399/101
2009/0196648 A1* 8/2009 Inoue ..... 399/101

FOREIGN PATENT DOCUMENTS

JP 2003-98843 4/2003
JP 2006-343773 A * 12/2006

* cited by examiner

*Primary Examiner*—Sophia S Chen
(74) *Attorney, Agent, or Firm*—Gerald E. Hespos; Michael J. Porco

(57) ABSTRACT

There are provided: a transfer belt which extends between a plurality of rollers so as to be capable of running in an endless manner, the transfer belt receiving on its front surface or a recording sheet placed on the front surface a toner image which is bore on an image bearing member in accordance with image information; a bending roller having a peripheral surface which is pressed against the front surface side of the transfer belt to bend inwardly the transfer belt which is in a state of extend between the plurality of rollers so as to be capable of running in an endless manner; a first blade which cleans the peripheral surface of the bending roller; a front surface side cleaning mechanism; and a collection crew which collects a foreign object removed by both the first blade and the front surface side cleaning mechanism.

6 Claims, 6 Drawing Sheets

TRANSFER UNIT AND IMAGE FORMING APPARATUS

BACKGROUND OF THE INVENTION

1. Field of the Invention.

The present invention relates to a transfer unit and an image forming apparatus. More particularly, it relates to a technology for cleaning both a transfer belt, to which a toner image is transferred from an image bearing member or which conveys a recording sheet to the image bearing member, and a bending roller which bends the transfer belt.

2. Description of the Background Art

Conventionally, there has been known an image forming apparatus capable of performing color printing, as disclosed in Japanese Patent Unexamined Publication No. 2003-98843. This image forming apparatus includes a plurality of image bearing members (photoconductive drums) bearing toner images of different colors, an intermediate transferring belt which rotates around a plurality of rollers so that the toner images of the image bearing members are sequentially transferred in superimposition, and a bending roller which comes in contact with a front surface side of the intermediate transferring belt to bend the intermediate transferring belt inwardly. The color image formed on the front surface of the intermediate transferring belt is transferred as a color image from the intermediate transferring belt to a recording sheet, and the recording sheet to which the color image is transferred is applied with a fixing processing and discharged to outside. The intermediate transferring belt is bent inwardly with the bending roller to make a space taken up by the intermediate transferring belt be small so that a cleaning device for cleaning the intermediate transferring belt can be arranged in the space secured by bending the intermediate transferring belt.

In the image forming apparatus disclosed in the publication, the bending roller serves as a cleaning roller for cleaning remaining toners electrically from the front surface of the intermediate transferring belt. Further, for the purpose of enhancing an efficiency of the bending roller in removing remaining toner from the intermediate transferring belt, there is provided a fur brush for scraping off a foreign object such as remaining toner from the front surface of the intermediate transferring belt on an upstream side from the bending roller in a running direction of the intermediate transferring belt.

SUMMARY OF THE INVENTION

The present invention was made by further improving the conventionally technology.

In summary, a transfer unit in accordance with an aspect of the present invention is mounted to an apparatus main body of an image forming apparatus and includes: a transfer belt which extends between a plurality of rollers so as to be capable of running in an endless manner, the transfer belt receiving on its front surface or a recording sheet placed on the front surface a toner image which is bore on an image bearing member in accordance with image information; a bending roller having a peripheral surface which is pressed against the front surface side of the transfer belt to bend inwardly the transfer belt which is in a state of extend between the plurality of rollers so as to be capable of running in an endless manner; a bending roller cleaning member which cleans the peripheral surface of the bending roller; a front surface side cleaning mechanism which cleans a front surface side of the transfer belt; and a collection section which collects a foreign object which is removed by both the bending roller cleaning member and the front surface side cleaning mechanism.

These and other objects, features and advantages of the present invention will become more apparent upon reading of the following detailed description along with the accompanied drawings.

DESCRIPTION OF THE PREFERRED EMBODIMENTS

Hereinafter, a transfer unit and an image forming apparatus in accordance with an embodiment of the present invention will be described with reference to the drawings.

Figure 1:
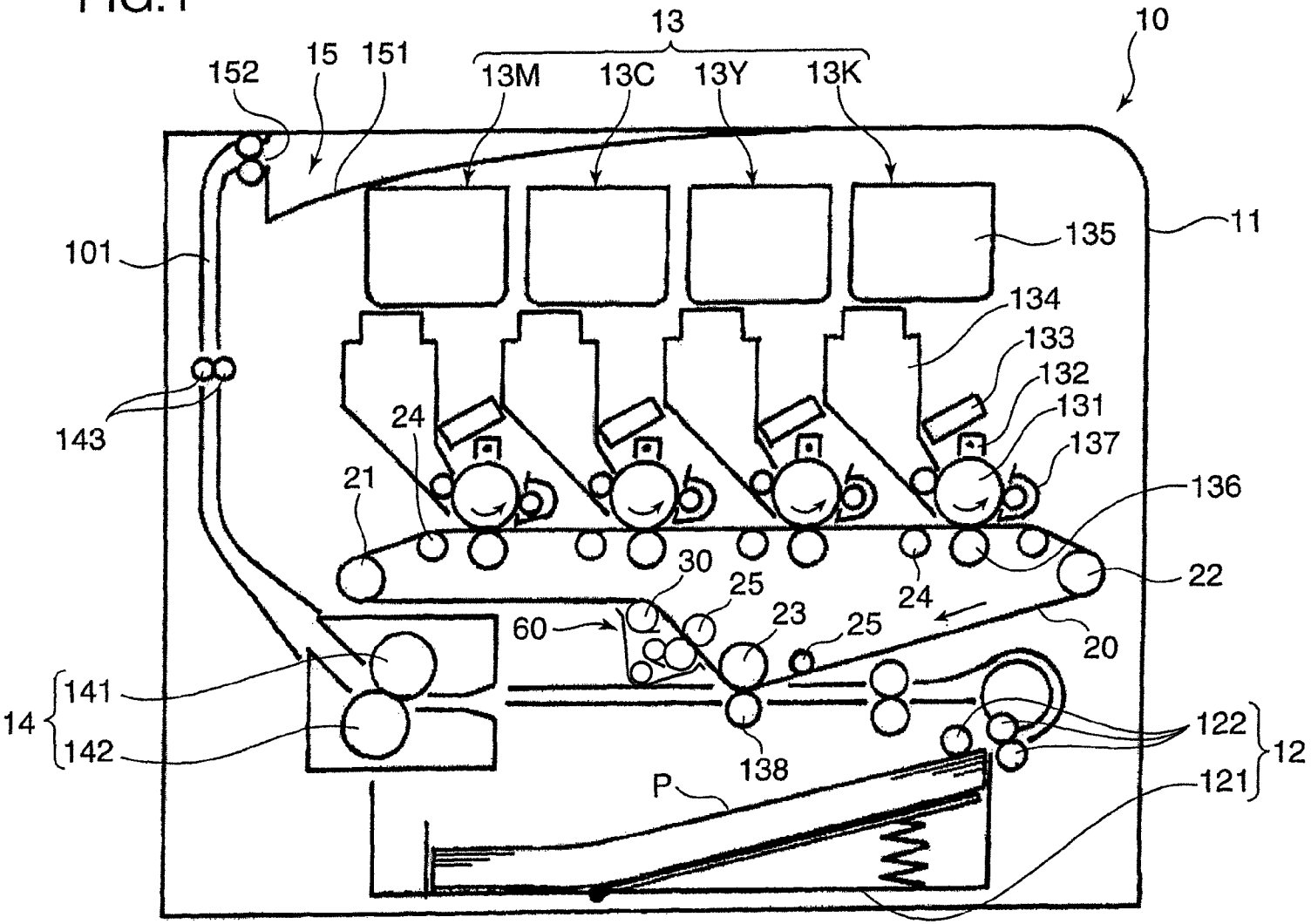
FIG. 1 is an explanatory drawing showing a cross-sectional view of an internal structure of an image forming apparatus in accordance with an embodiment of the present invention.
Figure 2:
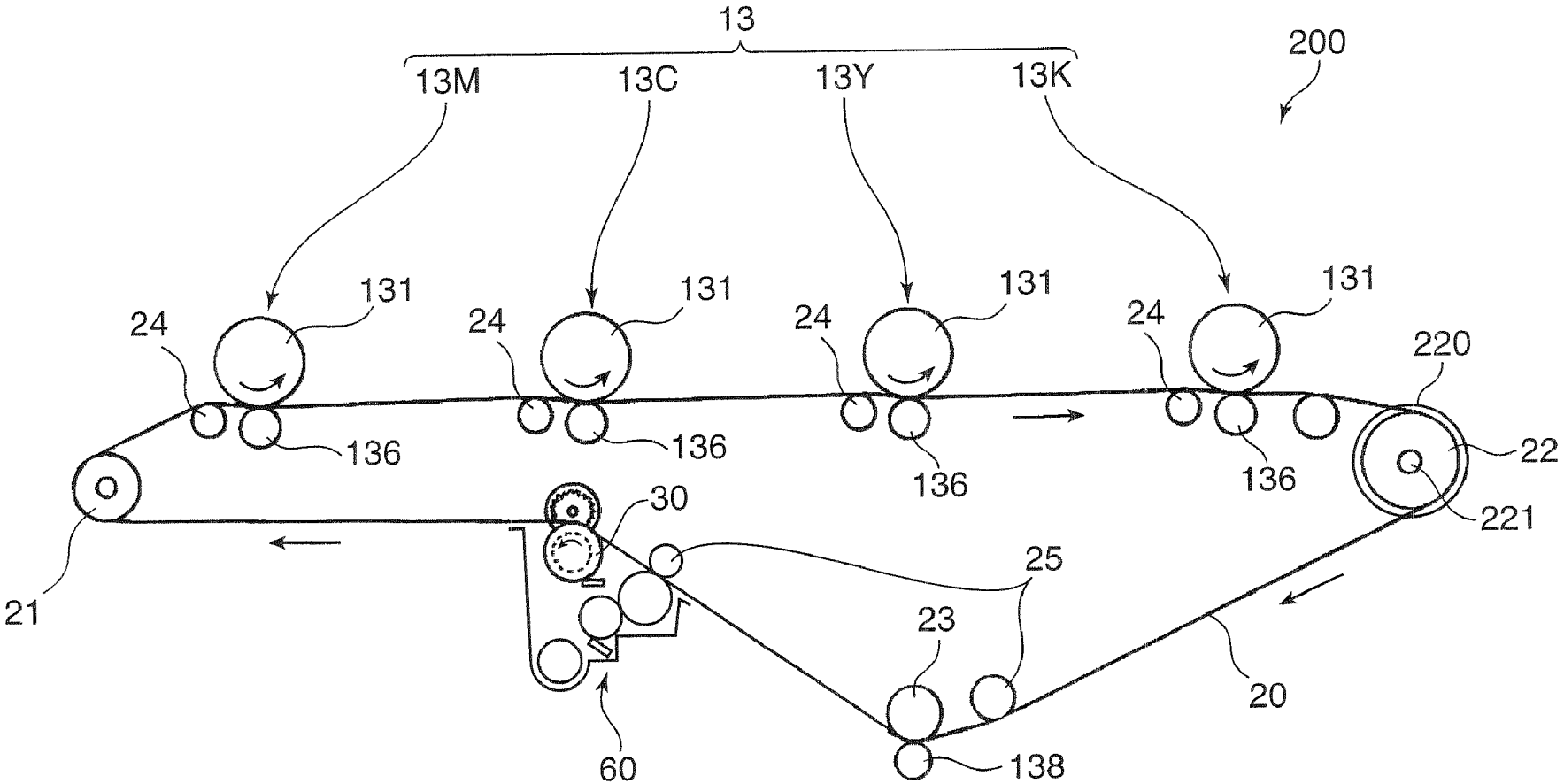
FIG. 2 extractively shows a transfer unit in accordance with the embodiment of the present invention.

FIG. 1 is an explanatory drawing showing a cross-sectional view of an internal structure of an image forming apparatus in accordance with an embodiment of the present invention. FIG. 2 extractively shows a transfer unit and a cleaning unit in accordance with an embodiment of the present invention.

In the present embodiment, a printer 10 is adopted as the image forming apparatus. As shown in FIG. 1, the printer 10 includes a sheet-supplying section 12 which stores a stack of sheets P, an image forming section 13 which transfers a toner image onto a sheet P conveyed from the sheet-supplying section 12, a fixing section 14 which applies a fixing processing to the toner image transferred to the sheet P by the image forming section 13, and a sheet-discharging section 15 to which the sheet P applied with the fixing processing by the fixing section 14 is discharged, each of which is mounted to an apparatus main body 11.

The sheet-supplying section 12 includes a sheet-supplying cassette 121 which is dismountably mounted in a lower portion of the apparatus main body 11 and capable of storing a plurality of sheets P, and a pickup roller 122 provided at an upper right position above the sheet-supplying cassette 121 in FIG. 1. The sheets P stored in the sheet-supplying cassette 121 are picked up one after another by driving of the pickup roller 122 and sent to the image forming section 13.

The image forming section 13 is adapted to form a toner image onto the sheet P supplied from the sheet-supplying section 12 and, in the present embodiment, includes a magenta unit 13M using magenta toner, a cyan unit 13C using cyan toner, a yellow unit 13Y using yellow toner, and a black unit 13K using black toner, all of which are sequentially arranged from an upstream side (left side on a sheet of FIG. 1) to a downstream side.

Each of the units 13M, 13C, 13Y, and 13K includes a photoconductive drum (image bearing member) 131 which has a peripheral surface on which an electrostatic latent image and a toner image based on the electrostatic latent image are formed and is rotatable about an axis extending in forward and backward direction (direction orthogonal to the sheet of FIG. 1), a charging device 132 having a charging wire which charges the peripheral surface of the photoconductive drum 131 to form a uniform electric charge on the peripheral surface, an exposure device 133 which irradiates a laser light based on image information onto the peripheral surface of the photoconductive drum 131 applied with the uniform electric charge by the charging device 132 to form an electrostatic latent image, a developing device 134 which supplies toner onto the peripheral surface of the photoconductive drum 131 formed with the electrostatic latent image to form a toner image on the peripheral surface, a toner container 135 which supplies toner to the developing device 134 and is dismountably mounted to each developing device 134, a primary transferring roller 136 which transfers the toner image formed on the photoconductive drum 131 to the front surface of an intermediate transferring belt (transfer belt) 20, which will be described later, by peeling off the toner image electrostatically, a drum cleaning device 137 which performs a cleaning processing with respect to the peripheral surface of the photoconductive drum 131 after the transferring processing to the intermediate transferring belt 20 is performed.

Further, in the image forming section 13, as common members for each of the units 13M, 13C, 13Y, and 13K, there are provided an intermediate transferring belt 20 whose upper portion comes in contact with a lower portion of each photoconductive drum 131 and onto which a toner image formed on the peripheral surface of the photoconductive drum 131 is transferred, and a secondary transferring roller 138 which peels off the toner image formed on the intermediate transferring belt 20 electrostatically and allows the toner image to be transferred onto the sheet P sent from the sheet-supplying section 12.

The photoconductive drum 131 is adapted to allow an electrostatic latent image and a toner image based on the electrostatic latent image to be formed on the peripheral surface, and an extremely flat and smooth amorphous silicon layer which is tough and excellent in abrasion resistance is layered on the peripheral surface so as to be suitable to form those images. Each photoconductive drum 131 rotates in a counter-clockwise direction in FIG. 1 and receives supply of toner from a corresponding developing device 134.

The charging device 132 is applied at its charging wire with a high voltage by an unillustrated power source, and a corona discharge caused by this forms a uniform electric charge on the peripheral surface of the photoconductive drum 131. In place of the charging device 132, a charging roller applied with a high voltage may come in contact with the peripheral surface of the photoconductive drum 131, so as to form an electric charge on the peripheral surface of the photoconductive drum 131.

The exposure device 133 is adapted to irradiate a laser light, which is based on image data inputted from an unillustrated computer or the like, to the peripheral surface of the photoconductive drum 131 uniformly charged by the charging device 132. The irradiation of the laser light forms the electrostatic latent image on the peripheral surface of the photoconductive drum 131. Supplying toner from the developing device 134 to the electrostatic latent image causes a toner image to be formed on the peripheral surface of the photoconductive drum 131, and then the toner image is transferred to the intermediate transferring belt 20 on which the toner image moves around.

The developing device 134 is provided with an agitating/conveying member inside, and a developing roller whose peripheral surface faces the peripheral surface of the photoconductive drum 131 is provided at a lowermost position. Rotation of the developing roller allows toner to be supplied to the peripheral surface of the photoconductive drum 131.

Onto the front surface of the intermediate transferring belt 20, toner images formed on peripheral surfaces of the photoconductive drums 131 in the respective units 13M, 13C, 13Y, and 13K are transferred sequentially in superimposition. Accordingly, a color image is formed on the front surface.

The transfer unit 200 in accordance with an embodiment of the present invention includes the intermediate transferring belt 20, a bending roller 30, a roller driving motor 40, a torque limiter 50, and a cleaning device 60.

The intermediate transferring belt 20 extends to be wound around primary transferring rollers 136 for the units 13M, 13C, 13Y, and 13K, the tension roller 21 provided on a slightly left position of the primary transferring roller 136 of the magenta unit 13M in FIG. 2, the driving roller 22 provided on a slightly right position of the primary transferring roller 136 of the black unit 13K in FIG. 2, the bending roller 30 which is provided, in the present embodiment, immediately under the primary transferring roller 136 of the cyan unit 13C on right of the tension roller 21 to bend the intermediate transferring belt 20, and a pressing roller 23 which is provided at a substantially intermediate position between and under the bending roller 30 and the driving roller 22.

The pressing roller 23 is adapted to press the intermediate transferring belt 20 against the secondary transferring roller 138 to thereby allow the color image formed on the intermediate transferring belt 20 to be reliably transferred to the sheet P which is conveyed in a state of being sandwiched between the intermediate transferring belt 20 and the secondary transferring roller 138.

The driving roller 22 is driven by the roller-driving motor (roller-driving power source) 220. The roller-driving motor 220 is provided on a back side (back side of the sheet of FIG. 2) of the driving roller 22 coaxially with the driving roller 22. The driving roller 22 fits over the driving shaft 221 of the roller-driving motor 220 integrally rotatably. Thus, the driving roller 22 is integrally rotated about the driving shaft 221 of the roller-driving motor 220 by driving of the roller-driving motor 220.

The respective peripheral surfaces of the driving roller 22, the tension roller 21, the pressing roller 23, and the primary transferring roller 136 come in contact with a back surface side of the intermediate transferring belt 20. On the other hand, the peripheral surface of the bending roller 30 comes in contact with the front surface side of the intermediate transferring belt 20. Thus, remaining toner on the front surface of the intermediate transfer belt 20 may be transferred to the peripheral surface of the bending roller 30. However, according to the present embodiment, the remaining toner is removed in such a manner as described hereinafter.

The secondary transferring roller 138 is pressed by the pressing roller 23 across the intermediate transferring belt 20 at a position immediately under the pressing roller 23. The secondary transferring roller 138 is applied with a bias voltage, which electrostatically peels off the toner image formed on the intermediate transferring belt 20, from an unillustrated power source. Thus, a toner image on the intermediate transferring belt 20 is transferred to the sheet P which passes through a portion between the intermediate transferring belt 20 and the secondary transferring roller 138.

Further, an upper driven roller 24 is provided on a left side of each primary transferring roller 136, and lower driven rollers 25 are provided respectively at positions between the bending roller 30 and the pressing roller 23 and between the driving roller 22 and the pressing roller 23. The upper and lower driven rollers 24 and 25 press the intermediate transferring belt 20 from an inner side to maintain a tensional state so that the intermediate transferring belt 20 is not loosened.

The fixing section 14 is adapted to apply a fixing processing to the image transferred to the sheet P in the image forming section 13 and includes a fixing roller 141 heated by an electric heating member such as a halogen lamp, and a pressing roller 142 which is so arranged as to face the fixing roller 141 in a lower portion and whose peripheral surface comes in press-contact with the peripheral surface of the fixing roller 141. As shown in FIG. 1, the fixing section 14 is arranged in a space formed by the pressure applied to the intermediate transferring belt 20 by the bending roller 30.

The sheet P to which the toner image is transferred from the intermediate transferring belt 20 by the secondary transferring roller 138 is led into the fixing section 14 while guided by rotation of the intermediate transferring belt 20 in a state of being sandwiched between the intermediate transferring belt 20 and the secondary transferring roller 138, so that the toner image is fixed to the sheet P by a heat applied when passing through a portion between the fixing roller 141 and the pressing roller 142.

The sheet P after being applied with the fix processing is conveyed upward through the sheet-discharging conveying passage 101 by driving of a pair of sheet-discharging rollers 143, passes through a sheet-discharging opening 152, and then is discharged to the sheet-discharging tray 151 provided on the top of the apparatus main body 11.

Further, at a position where the bending roller 30 is provided, there is provided a cleaning device 60 which cleans the bending roller 30 and applies a cleaning processing to the intermediate transferring belt 20 after the transfer processing with respect to the sheet P is completed. The intermediate transferring belt 20, after being applied with the cleaning processing by the cleaning device 60, passes through the bending roller 30 and moves to the photoconductive drums 131 of the units 13M, 13C, 13Y, and 13K for the next transfer processing.

Figure 3:
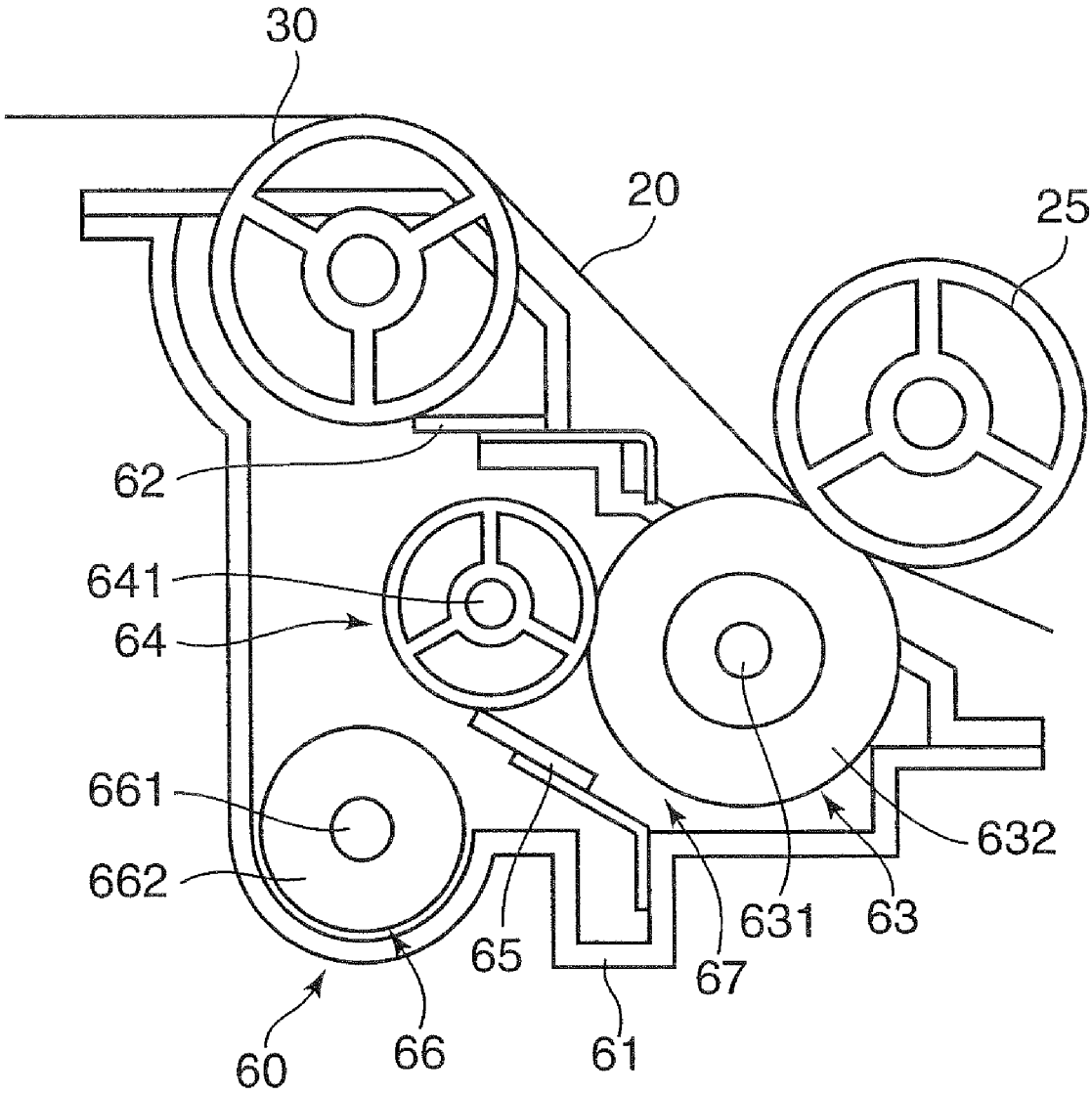
FIG. 3 is a side sectional view schematically showing an internal configuration of a cleaning device.

FIG. 3 is a side sectional view schematically showing an internal configuration of the cleaning device 60. The cleaning device 60 includes a casing 61, a first blade 62, a front surface side cleaning mechanism 67, and a collection screw 66.

The casing 61 has a box-like shape and is provided inside with the bending roller 30, the first blade 62, a cleaning brush 63, a collection roller 64, a second blade 65, and a collection screw 66.

The first blade (bending roller cleaning member) 62 removes a foreign object (such as remaining toner moved from the intermediate transferring belt 20) adhered to the peripheral surface of the bending roller 30. The first blade 62 is a blade-like member whose leading edge portion comes in contact with the peripheral surface of the bending roller 30. In the present embodiment, when the bending roller 30 is rotated in the counter-clockwise direction about a roller axis by rotation of the intermediate transferring belt 20 in the clockwise direction, the leading edge portion of the blade 62 comes in slide contact with the peripheral surface of the bending roller 30, so that a foreign object adhered to the peripheral surface of the bending roller 30 is scraped off.

The front surface side cleaning mechanism 67 includes the cleaning brush 63, the collection roller 64, and the second blade 65.

The cleaning brush 63 is provided at a position facing the lower driven roller 25 across the intermediate transferring belt 20 on an upstream side from the bending roller 30 in the running direction of the intermediate transferring belt 20. The cleaning brush 63 includes a rotational shaft 631 extending in parallel with the lower driven roller 25 and provided in the casing 61 and a brush portion 632 having a large number of bristles which are evenly implanted to a peripheral surface of the rotational shaft 631 so as to extend radially from the rotational shaft 631. The length of each bristle is so set that an outer peripheral surface of the brush portion 632 formed by leading ends of the large number of bristles comes in contact with the front surface of the intermediate transferring belt 20.

On a back surface side of the casing 61 (back side of the sheet of FIG. 3), there is provided an unillustrated brush motor. The brush motor is connected with a driving shaft which transmits a rotational drive force to the rotational shaft 631 of the cleaning brush 63. Driving of the brush motor allows the brush portion 632 to rotate about the rotational shaft 631 in a direction reversing the running direction of the intermediate transferring belt 20 or in a direction following the running direction of the intermediate transferring belt 20 with a difference in a peripheral speed with respect to the running of the intermediate transferring belt 20. Accordingly, the front surface side of the intermediate transferring belt 20 is cleaned by the brush portion 632, so that a foreign object adhered to the front surface side of the intermediate transferring belt 20 is removed and cleaned.

The collection roller 64 collects a foreign object removed by the cleaning brush 63 from the front surface of the intermediate transferring belt 20 from the cleaning brush 63. The collection roller 64 is provided on a downstream side in the rotational direction of the cleaning brush 63 from a contact position between the intermediate transferring belt 20 and the cleaning brush 63. The collection roller 64 is so provided that a part of the peripheral surface of the collection roller 64 comes in contact with the outer peripheral surface of the brush portion 632 at that position. The collection roller 64 is rotated about the rotational shaft 641 by a drive force exerted by an unillustrated drive power source in a direction reversing the rotational direction of the cleaning brush 63 or in a direction following the rotational direction of the cleaning brush 63 with a difference in peripheral speed with respect to the rotation of the cleaning brush 63, so that a foreign object adhered to the brush portion 632 of the cleaning brush 63 is removed. The peripheral surface of the cleaning brush 63, after being cleaned by the collection roller 64, comes in contact with the front surface of the intermediate transferring belt 20 again.

The second blade (collection roller cleaning member) 65 removes the foreign object from the collection roller 64. The second blade 65 is a blade-like member whose leading edge portion comes in contact with the peripheral surface of the collection roller 64. When the collection roller 64 is rotated, the second blade 65 scrapes off a foreign object adhered to the peripheral surface of the collection roller 64 since the leading edge portion of the second blade 65 is in slide contact with the peripheral surface of the collection roller 64.

The collection screw (collection section) 66 collects both a foreign object removed from the peripheral surface of the bending roller 30 by the first blade 62 and a foreign object removed from the peripheral surface of the collection roller 64 by the second blade 65.

In the present embodiment, the collection roller 64 and the second blade 65 are provided in a space formed by bending the intermediate transferring belt 20 with the bending roller 30 at positions under the intermediate transferring belt 20 on an upstream side from the bending roller 30 and the first blade 62 in the running direction of the intermediate transferring belt 20 and at positions under the bending roller 30 and the first blade 62. Further, the collection screw 66 is arranged at a position to which both a foreign object removed from the bending roller 30 by the first blade 62 and a foreign object removed from the collection roller 64 by the second blade 65 fall down.

The collection screw 66 has a spiral-like fin member 662 which is provided on a peripheral surface of the rotational shaft 661 in a spiral-like manner. When the collection screw 66 is rotated by a drive force from an unillustrated drive power source about a rotational shaft 661, the collection screw 66 collects both a foreign object removed from the bending roller 30 by the first blade 62 and a foreign object removed from the collection roller 64 by the second blade 65 to any one of end portions of the rotational shaft 661 of the collection screw 66 (in other words, an end portion of the casing 61) with use of the fin member 662.

Further, as shown in FIG. 3, the collection roller 64 is so provided that at least a part of the collection 64 is provided under a contact portion between the leading edge portion of the first blade 62 and the peripheral surface of the bending roller 30 (in other words, a position at which the first blade 62 removes a foreign object from the bending roller 30). Accordingly, when a foreign object removed from the bending roller 30 by the first blade 62 falls down, the foreign object is directly collected by the collection screw 66, or temporarily collected by the collection roller 64, removed from the collection roller 64 by the second blade 65, and collected by the collection screw 66. Therefore, the cleaning device 60 including the first blade 62, the collection roller 64, the second blade 65, and the cleaning brush 63 can be downsized in the running direction of the intermediate transferring belt 20, without lowering an efficiency of collecting a foreign object removed from the bending roller 30 by the first blade 62 to the collection screw 66.

Further, in the present embodiment, the tension roller 21, the pressing roller 23, the upper driven roller 24, and the lower driven roller 25 are driven by the rotation of the intermediate transferring belt 20, and on the other hand, the bending roller 30 is rotated by the driving of a roller driving motor (bending roller driving mechanism driving motor) 40 through a torque limiter 50 (which will be described later).

Figure 4:
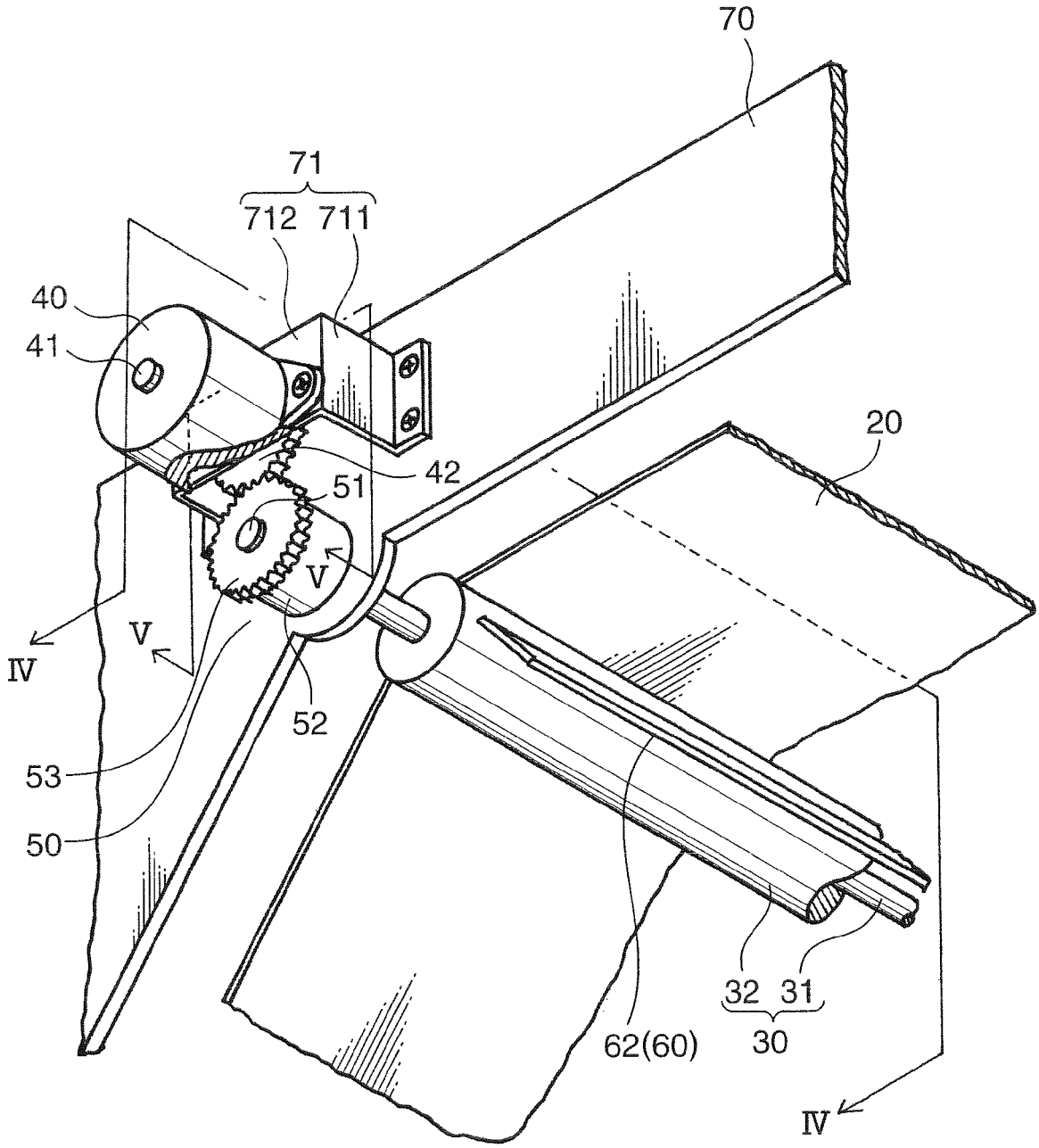
FIG. 4 is a partially notched perspective view showing the bending roller, a roller driving motor, and a torque limiter.
Figure 5:
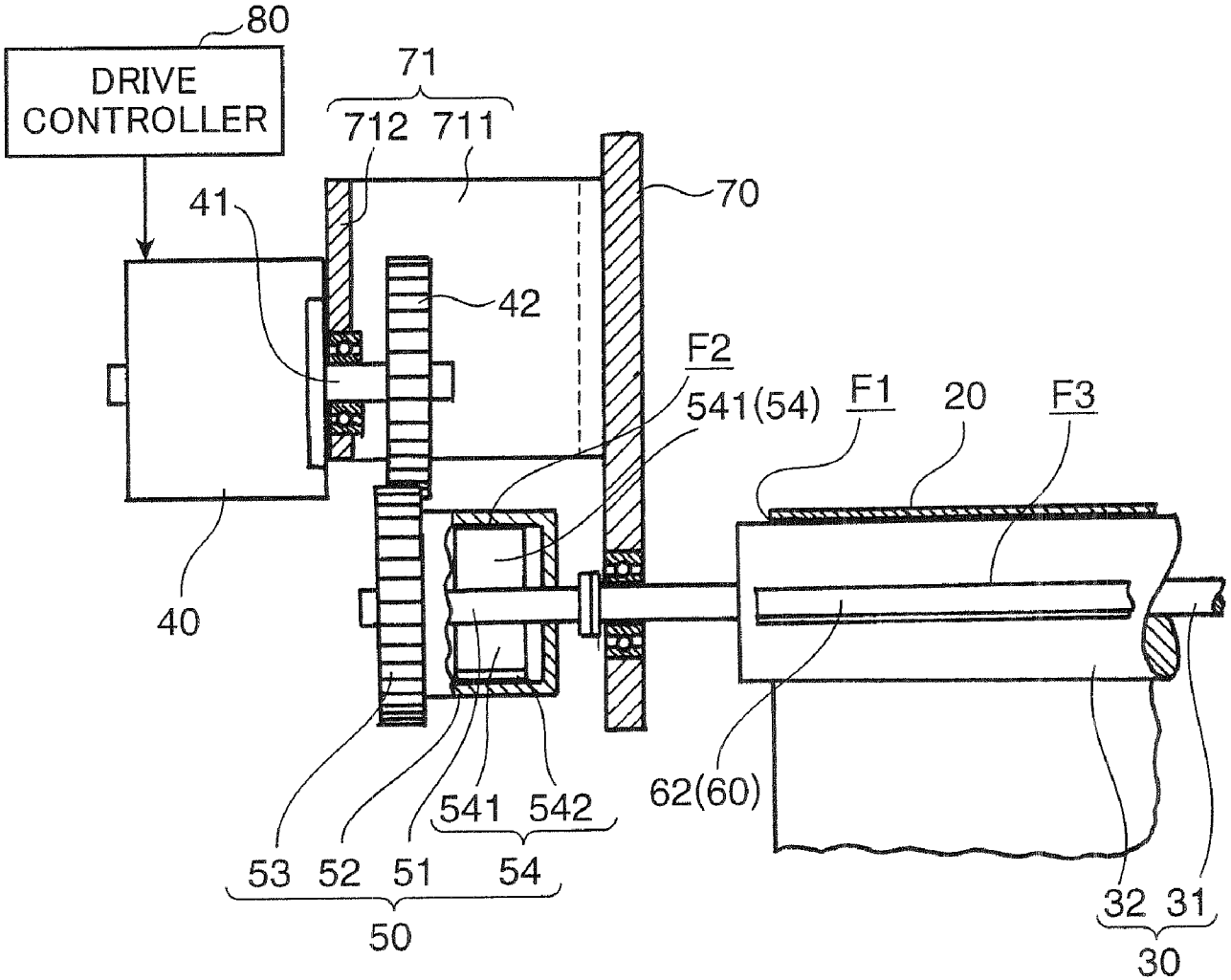
FIG. 5 is a sectional view taken along IV-IV line in FIG. 4.
Figure 6:
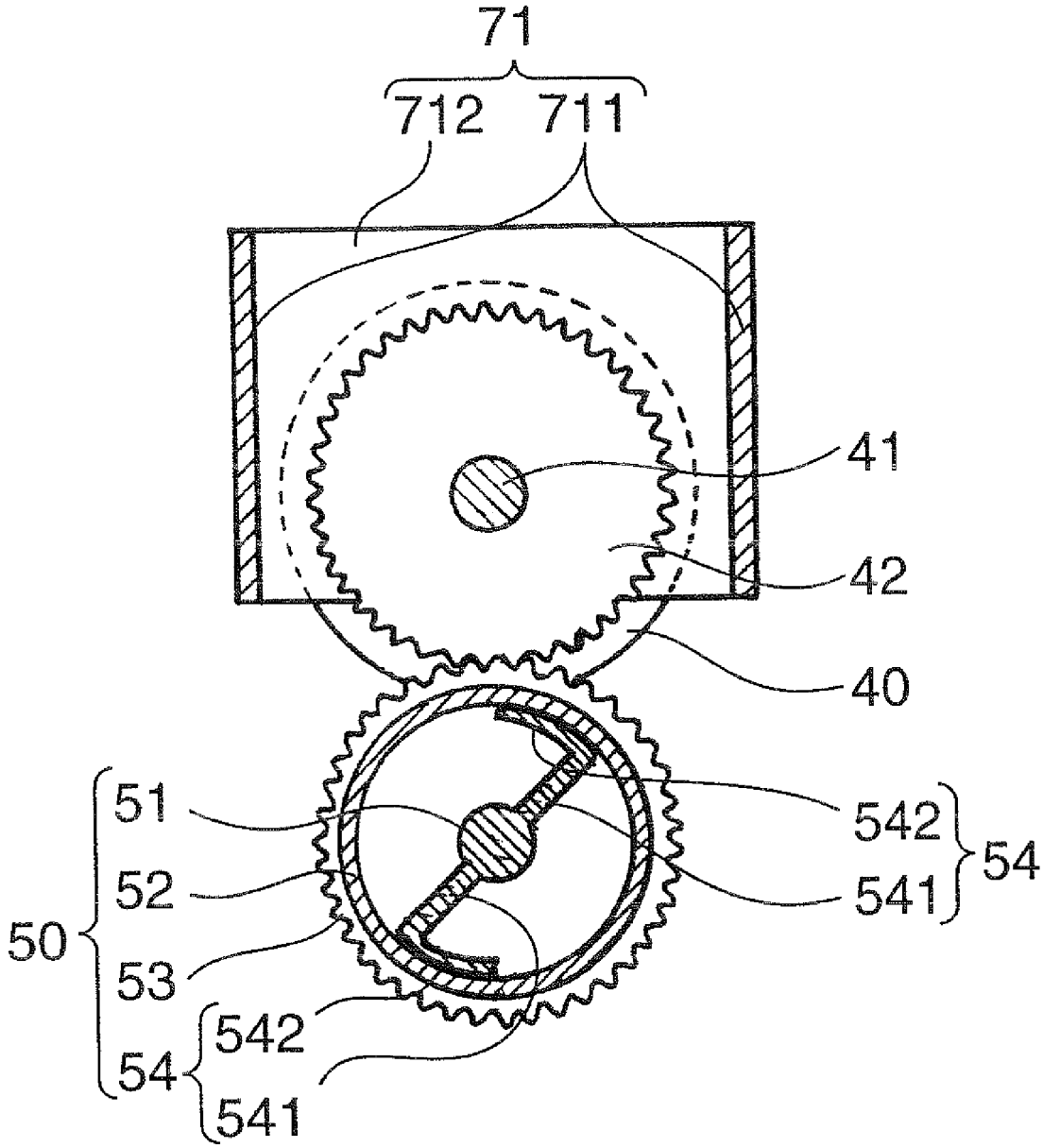
FIG. 6 is a sectional view taken along V-V line in FIG. 4.

FIG. 4 is a partially notched perspective view showing the bending roller 30, the roller driving motor 40, and the torque limiter 50. FIG. 5 is a sectional view taken along IV-IV line in FIG. 4. FIG. 6 is a sectional view taken along V-V line in FIG. 4.

Firstly, in the printer main body 11, there are provided a pair of frame plates 70 which face each other in the direction perpendicular to the rotational direction of the intermediate transferring belt 20 as shown in FIG. 4, and the rollers such as the driving roller 22, the tension roller 21, the pressing roller 23, the bending roller 30, and the like are provided between the pair of frame plates 70. FIG. 4 shows one side of the pair of frame plates 70 and the bending roller 30.

On the other hand, the bending roller 30 includes a bending roller shaft 31 which extends between the pair of frame plates 70 and a bending roller main body 32 which is fitted over the bending roller shaft 31 integrally rotatably and formed by a non-elastic member such as an aluminum alloy, a stainless steel, or the like.

The torque limiter 50 is provided coaxially at an end portion of the bending roller shaft 31 projecting outwardly from the frame plate 70. The torque limiter 50 includes a center shaft 51 which is connected with the bending roller shaft 31 integrally rotatably, a limiter cylindrical body 52 which is fitted over the center shaft 51 coaxially in a relatively rotatable manner, a limiter-side gear 53 which is fitted over the limiter cylindrical body 52 coaxially in an integrally rotatable manner, and a pair of resistance bodies 54 provided in the limiter cylindrical body 52 and projecting radially from the center shaft 51 in opposite directions.

The resistance body 54 is formed by bending a plate spring member to be L-shaped and includes a rectangular flat plate portion 541 projecting from the center shaft 51 and an arc plate portion 542 which is bent from a leading end of the flat plate portion 541 toward the rotational direction of the center shaft 51 and formed to be arc-shaped so as to come in surface contact with the inner circumferential surface of the limiter cylindrical body 52.

The arc plate portion 542 is accommodated in the limiter cylindrical body 52 in a state where a connection portion with respect to the flat plate portion 541 is slightly elastically deformed, thereby pressing the inner circumferential surface of the limiter cylindrical body 52 with a predetermined elastic force. Accordingly, a predetermined frictional force (torque limiter frictional force F2) may occur between the arc plate portion 542 and the inner circumferential surface of the limiter cylindrical body 52.

On the other hand, a frictional force (roller/belt frictional force F1) which occurs between the bending roller main body 32 and the intermediate transferring belt 20 causes the rotation of the intermediate transferring belt 20 to the bending roller main body 32. A friction is so set that the roller/belt frictional force F1 becomes greater than the torque limiter frictional force F2 (F1>F2).

Further, the first blade 62 of the cleaning device 60 comes in contact with the peripheral surface of the bending roller main body 32. A frictional force which occurs between the first blade 62 and the peripheral surface of the bending roller main body 32 (blade/roller frictional force (load force) F3) is so set as to be less than the torque limiter frictional force F2 (F3<F2).

Thus, the respective frictional force are so set that, the roller/belt frictional force F1 is the largest, subsequently the torque limiter frictional force F2 is large, and the blade/roller frictional force F3 is the smallest (F1>F2>F3).

The roller driving motor 40 is attached to a bracket 71 having a substantially rectangular shape in a plan view, provided on an external surface side of the frame plate 70, and fixed immediately above the torque limiter 50. The bracket 71 includes a pair of side plates 711 projecting outwardly from the frame plates 70 and a back plate 712 extending between leading edge portions of the pair of side plates 711. The roller driving motor 40 is mounted to the back plate 712 in a state of allowing the driving shaft 41 to penetrate through the back plate 712.

A drive gear 42 which is in mesh with the limiter-side gear 53 is fitted over the driving shaft 41 coaxially and integrally rotatably at a portion penetrating through the back plate 712 and positioned in the bracket 71. Thus, driving of the roller driving motor 40 is transmitted to the limiter cylindrical body 52 of the torque limiter 50 through the driving shaft 41, the drive gear 42, and the limiter-side gear 53. The rotation of the limiter cylindrical body 52 is transmitted to the bending roller 30 through the resistance body 54 and the center shaft 51.

In the present embodiment, a speed of the roller driving motor 40 is so set that the peripheral speed of the bending roller main body 32 becomes faster than the rotational speed of the intermediate transferring belt 20 under a condition where the friction is set as described above and the bending roller 30 is not limited by the torque limiter 50, in other words, the bending roller 30 is rotated in a free state without a load (hereinafter, referred to as a free rotation).

For the purpose of setting the speed as described above, a drive controller 80 (FIG. 5) which consists of a microcomputer is provided at an appropriate portion in the printer main body 11, and the roller driving motor 40 rotationally drives in accordance with a control by the drive controller 80. In other words, a rotational speed of the intermediate transferring belt 20 is inputted to the drive controller 80. Then, the drive controller 80 performs an arithmetic calculation so that the peripheral speed of the bending roller 30 becomes faster than the rotational speed of the intermediate transferring belt 20 by a predetermined rate. Then, the drive controller 80 outputs a control signal in accordance with the result of the arithmetic calculation to the roller driving motor 40. Thus, the driving of the roller driving motor 40 to which a control signal is inputted causes the peripheral speed of the bending roller 30 to be slightly faster than the rotational speed of the intermediate transferring belt 20 always at the time of free rotation where no limitation is applied by the torque limiter 50.

Thus, when the roller driving motor 40 and the belt driving motor 210 are driven simultaneously, the intermediate transferring belt 20 is rotated with a drive force of the belt driving motor 210. However, at this time, the bending roller main body 32 tends to be rotated by a drive force of the roller driving motor 40 at a peripheral speed which is faster than the rotational speed of the intermediate transferring belt 20.

However, since the drive force of the roller driving motor 40 is transmitted to the bending roller 30 through the resistance body 54 which is in contact with the inner circumferential surface of the limiter cylindrical body 52 of the torque limiter 50, and the torque limiter frictional force F2 which is a frictional force occurring between the arc plate portion 542 of the resistance body 54 and the inner circumferential surface of the limiter cylindrical body 52 is so set as to be smaller than the roller/belt frictional force F1 which is a frictional force between the intermediate transferring belt 20 and the bending roller main body 32, eventually a slipping occurs between the resistance body 54 and the limiter cylindrical body 52. Accordingly, the bending roller main body 32 falls in a state similar to the state of being rotated by the intermediate transferring belt 20. In other words, the bending roller 30 is rotated at the same peripheral speed as the rotational speed of the intermediate transferring belt 20.

As described above, the difference between the peripheral speed of the bending roller 30 at the time when the bending roller 30 is freely rotated by the roller driving motor 40 and the rotational speed of the intermediate transferring belt 20 is so set as not to be large. Accordingly, as comparing to the case where the bending roller 30 is driven only by the rotation of the intermediate transferring belt 20, the degree of rubbing between the peripheral surface of the bending roller main body 32 and the surface of the intermediate transferring belt 20 is small. Therefore, it can effectively prevent occurrence of a disadvantageous degradation of image quality of an image transferred to the sheet P due to the transfer of a foreign object such as remaining toner on the peripheral surface of the bending roller main body 32 caused by the rubbing to the intermediate transferring belt 20 again.

Further, the blade/roller frictional force F3 which is a frictional force between the blade 62 and the bending roller main body 32 is so set as to be smaller than the torque limiter frictional force F2 which is a frictional force between the inner circumferential surface of the limiter cylindrical body 52 and the arc plate portion 542 of the resistance body 54. Accordingly, it can prevent occurrence of a disadvantage that the bending roller 30 is not rotated due to the excessively large blade/roller frictional force F3.

Further, in the present embodiment, when the image forming processing is executed while rotating the intermediate transferring belt 20, the roller driving motor 40 is started up slightly earlier than starting up of belt driving motor 210 in accordance with a control signal outputted from the drive controller 80 to the roller driving motor 40. Accordingly, since a drive force of the roller driving motor 40 is transmitted to the bending roller 30 through the resistance body 54 which tends to slip before the rotation of the intermediate transferring belt 20 (in other words, the bending roller 30 is not rotated due to non-rotation of the intermediate transferring belt 20, but a force caused by driving of the roller driving motor 40 is transmitted to the bending roller 30), when the intermediate transferring belt 20 starts up, the bending roller 30 can follow the starting up of the intermediate transferring belt 20. Therefore, the degree of rubbing between the peripheral surface of the bending roller main body 32 and the surface of the intermediate transferring belt 20 at the time of starting up can be made ultimately small, so that transfer of a foreign object from the peripheral surface of the bending roller main body 32 to the surface of the intermediate transferring belt 20 can be effectively suppressed.

The roller driving motor 40, the driving shaft 41, the drive gear 42, and the torque limiter 50 are examples of the bending roller driving mechanism according to claims of the present invention.

As specifically described above, the printer (image forming apparatus) 10 in accordance with the present embodiment is capable of performing a color printing and provided with a plurality of photoconductive drums 131 bearing toner images in accordance with predetermined image information and the intermediate transferring belt 20 which sequentially receives toner images of the photoconductive drums 131 in superimposition and extends between a plurality of rollers (the driving roller 22, the tension roller 21, the pressing roller 23, the upper driven roller 24, the lower driven roller 25, the bending roller 30, and the like).

The printer 10 includes a plurality of photoconductive drums 131 which bear toner images in accordance with predetermined image information, an intermediate transferring belt 20 which extends between a plurality of rollers and sequentially receives toner images of the photoconductive drums 131 in superimposition, a bending roller 30 whose peripheral surface comes in press-contact with the front surface of the intermediate transferring belt 20 to bend the intermediate transferring belt 20 inwardly, a torque limiter 50 which is mounted to a rotational shaft of the bending roller 30, a roller driving motor 40 which applies a drive force to the bending roller 30 through the torque limiter 50, and a drive controller 80 which drives the roller driving motor 40 such that the peripheral speed of the bending roller 30 in the case of not being limited by the torque limiter 50 becomes faster than the rotational speed of the intermediate transferring belt 20.

According to this configuration, if the rotational speed of the intermediate transferring belt 20 is changed within a range in which so-called free peripheral speed, which is a peripheral speed of the bending roller 30 in the case where limitation by the torque limiter 50 controlled by the drive controller 80 is not applied, the torque limiter 50 absorbs the change (in particular, the torque limiter 50 slides with the bending roller 30 to absorb the change in speed of the intermediate transferring belt 20). Consequently, the bending roller 30 can be rotated at the same speed as the rotational speed of the intermediate transferring belt 20.

Thus, it can effectively prevent occurrence of disadvantages such as scars or fine powders occurred in the intermediate transferring belt 20 due to rubbing between the front surface of the intermediate transferring belt 20 and the peripheral surface of the bending roller 30 by the difference in speeds.

For the purpose of securing the aforementioned effect, in the present embodiment, the torque limiter frictional force F2 which occurs between the arc plate portion 542 of the resistance body 54 and the inner circumferential surface of the limiter cylindrical body 52 in the torque limiter 50 is so set as to be smaller than the roller/belt frictional force F1 which is a frictional force between the intermediate transferring belt 20 and the bending roller 30. In such manner, slipping occurs in the torque limiter 50, so that the rotational speed of the bending roller 30 toward the circumferential direction of the peripheral surface can be reliably matched with the rotational speed of the intermediate transferring belt 20.

Further, in the present embodiment, there is provided the cleaning device 60 which cleans the peripheral surface of the bending roller 30. Accordingly, a foreign object such as remaining toner transferred from the surface of the intermediate transferring belt 20 to the peripheral surface of the bending roller 30 is cleaned by the cleaning device 60, so that image degradation due to returning of the contamination on the peripheral surface of the bending roller 30 to the front surface of the intermediate transferring belt 20 can be eliminated.

In the present embodiment, the roller/belt frictional force F1, the torque limiter frictional force F2, and the blade/roller frictional force (load force) F3 have the relationship of "F1>F2>F3." Accordingly, it can prevent a disadvantage that a load force of the cleaning device 60 causes the bending roller 30 not to rotate.

Further, in the present embodiment, when the intermediate transferring belt 20 is started up, the bending roller 30 is started up precedingly before the starting up of the intermediate transferring belt 20. Accordingly, in the state where the bending roller 30 is started up precedingly before the starting up of the intermediate transferring belt 20, the torque limiter 50 causes the bending roller 30 not to rotate until the intermediate transferring belt 20 is started up. However, the bending roller 30 may follow to rotate immediately after the starting up of the intermediate transferring belt 20. Thus, when the intermediate transferring belt 20 is started up, the bending roller 30 follows to rotate without any time lag with respect to the starting up of the intermediate transferring belt 20, as compared to the case of simultaneous starting up. Accordingly, occurrence of rubbing between the bending roller 30 and the intermediate transferring belt 20 due to the difference in speeds can be prevented effectively.

The present invention is not limited to the embodiment and may include the following contents.

In the above-described embodiment, the printer 10 is described as an example of the image forming apparatus according to an aspect of the present invention. However, the present invention is not limited to that the image forming apparatus be the printer 10. The image forming apparatus may be a copying machine, a facsimile machine, a complex machine, or the like.

In the above-described embodiment, the cleaning device 60 of the printer 10 includes the first blade 62 and the second blade 65 which clean the peripheral surfaces of the bending roller 30 and the collection roller 64 respectively. In place of this, for cleaning the peripheral surfaces of the bending roller 30 and the collection roller 64, cleaning rollers may be provided respectively, so that the peripheral surface of the bending roller 30 or collection roller 64 may be cleaned by the respective cleaning rollers with the difference in peripheral speeds between the peripheral surface of the cleaning roller and the bending roller 30 or the peripheral surface of the collection roller 64.

In the above-described embodiment, the torque limiter 50 of a type which allows the arc plate portion 542 of the resistance body 54 comes in contact with the inner circumferential surface of the limiter cylindrical body 52 is adopted. However, in place of the torque limiter 50 of the aforementioned type, various types of torque limiters such as a clutch-plate type which uses a coil spring to allow clutch plates facing each other to come in slide contact with each other, a type in which a high-viscosity liquid is sealed between a pair of clutch plates, and the like may be adopted.

In the above-described embodiment, as a transfer belt, and the intermediate transferring belt 20 in which a color image is formed in superimposition on the front surface of the belt is adopted. In place of the intermediate transferring belt 20, as a transfer belt in accordance with an aspect of the present invention, so-called sheet conveying belt may be adopted which allows a color image to be formed on a sheet conveyed by the belt. Further, in the aforementioned embodiment, an image bearing member adopting a plurality of photoconductive drums 131 for respective colors is shown. However, an image bearing member of one-drum type for color printing which sequentially forms toner images of respective colors onto the peripheral surfaces of one photoconductive drum may be adopted. Further, the image forming apparatus according to the present invention is not limited to the one for color printing but may be the one for monochromatic printing. In this case, surely only one photoconductive drum is adopted.

Further, in the above-described embodiment, the collection screw 66 is arranged at position where both a foreign object removed from the bending roller 30 by the first blade 62 and a foreign object removed from the collection roller 64 by the second blade 65 fall down. However, not limited to this configuration, the collection screw 66 may be arranged at any position as long as it collects both a foreign object removed from the bending roller 30 by the first blade 62 and a foreign object removed from the collection roller 64 by the second blade 65.

Further, in the present embodiment, the collection roller 64 is provided under the position where the first blade 62 removes the foreign object from the bending roller 30. However, not limited to this configuration, the collection screw 66 may be provided at any position as long as it collects both a foreign object removed from the bending roller 30 by the first blade 62 and a foreign object removed from the collection roller 64 by the second blade 65.

In summary, a transfer unit according to an aspect of the present invention is a transfer unit which is mounted to an apparatus main body of an image forming apparatus, and the transfer unit includes: a transfer belt which extends between a plurality of rollers so as to be capable of running in an endless manner, the transfer belt receiving on its front surface or a recording sheet placed on the front surface a toner image which is bore on an image bearing member in accordance with image information; a bending roller having a peripheral surface which is pressed against the front surface side of the transfer belt to bend inwardly the transfer belt which is in a state of extend between the plurality of rollers so as to be capable of running in an endless manner; a bending roller cleaning member which cleans the peripheral surface of the bending roller; a front surface side cleaning mechanism which cleans a front surface side of the transfer belt; and a collection section which collects a foreign object which is removed by both the bending roller cleaning member and the front surface side cleaning mechanism.

Further, according to an aspect of the present invention, an image forming apparatus includes: a transfer unit; and an apparatus main body to which the transfer unit is mounted, wherein the transfer unit includes: a transfer belt which extends between a plurality of rollers so as to be capable of running in an endless manner, the transfer belt receiving on its front surface or a recording sheet placed on the front surface a toner image which is bore on an image bearing member in accordance with image information; a bending roller having a peripheral surface which is pressed against the front surface side of the transfer belt to bend inwardly the transfer belt which is in a state of extend between the plurality of rollers so as to be capable of running in an endless manner; a bending roller cleaning member which cleans the peripheral surface of the bending roller; a front surface side cleaning mechanism which cleans a front surface side of the transfer belt; and a collection section which collects a foreign object which is removed by both the bending roller cleaning member and the front surface side cleaning mechanism.

According to this invention, the bending roller cleaning member cleans the peripheral surface of the bending roller contaminated by a foreign object which moves from the transfer belt, and the front surface side cleaning mechanism cleans the front surface of the transfer belt, and the collection section collects foreign objects collected by both the bending roller cleaning member and the front surface side cleaning mechanism. Accordingly, the number of parts of the cleaning mechanism provided to clean the transfer belt can be reduced, and a space required for the cleaning mechanism and the image forming apparatus to which the cleaning mechanism is mounted can be reduced.

For example, a transfer unit is provided in a conventional image forming apparatus. However, in the transfer unit, the bending roller serves as a cleaning roller which electrically removes remaining toner from the surface of the transfer belt. Further, for the purpose of enhancing an efficiency in removing remaining toners from the transfer belt with use of the bending roller, a fur brush which scrapes off a foreign object such as remaining toner from the surface of the transfer belt is provided on an upstream side from the bending roller in the running direction of the transfer belt. In the case of the conventional image forming apparatus and transfer unit, the cleaning mechanism configured by the bending roller, the fur brush, and the like has a large number of parts, and the cleaning device becomes large in size. However, according to the present invention, the number of parts of the cleaning mechanism which cleans the transfer belt can be reduced, so that a space for the cleaning mechanism, the image forming apparatus to which the cleaning mechanism is mounted, and the transfer unit can be reduced.

Further, according to an aspect of the present invention, the bending roller of the transfer unit is a non-elastic member, and the bending roller cleaning member is a blade-like member whose end portion comes in contact with a peripheral surface of the bending roller.

According to this invention, since the bending roller is a non-elastic member, the bending roller is not deformed at a time of pressing the transfer belt. Therefore, a running path of the transfer belt in the state of being in contact with the bending roller becomes stable, so that a lead applied to the transfer belt by pressure of the bending roller is reduced to run the transfer belt. On the other hand, if the running path of the transfer belt is made constant by making the bending roller be non-elastic member, the peripheral surface of the bending roller becomes likely to be contaminated by a foreign object moved from the front surface of the transfer belt. However, by allowing an end portion of the blade-like bending roller cleaning member to come in contact with the peripheral surface of the bending roller to clean the peripheral surface of the bending roller, the peripheral surface of the bending roller is kept clean. Accordingly, reduction of a load against the transfer belt running in a state of being pressed by the bending roller and prevention of contamination on the peripheral surface of the bending roller can be achieved at the same time.

Further, according to an aspect of the present invention, the transfer unit further includes: a roller drive power source which exerts a rotational drive force to the rollers between which the transfer belt extends; a bending roller driving mechanism which exerts a rotational drive force to the bending roller; and a drive controller which controls driving of the bending roller driving mechanism. The drive controller controls driving of the bending roller driving mechanism so that a running speed of the transfer belt which runs in an endless manner by rotation of the roller in accordance with a rotational drive force exerted from the roller drive power source and a peripheral speed of the bending roller which rotates in a state of being in contact with the bending roller cleaning member.

For example, in a case of allowing the blade-like bending roller cleaning member to come in contact with the bending roller, a torque caused by a contact between the transfer belt and the bending roller cleaning member becomes larger than a force applied by the transfer belt to rotate the bending roller so that the peripheral speed of the bending roller and the running speed of the transfer belt does not match with each other. Accordingly, when the difference between the peripheral speed of the bending roller and the running speed of the transfer belt causes slipping between the transfer belt and the bending roller, there is likelihood that a scar which occurs in the transfer belt and the bending roller affects an image. However, according to the present invention, the drive controller controls driving of the bending roller driving mechanism such that the running speed of the transfer belt and the peripheral speed of the bending roller which rotates in a state of being in contact with the bending roller cleaning member match with each other. Accordingly, even if the belt-like bending roller cleaning member comes in contact with the bending roller, slipping does not occur between the transfer belt and the bending roller, so that lowering in image quality can be prevented.

Further, according to an aspect of the present invention, the front surface side cleaning mechanism of the transfer unit includes: a cleaning brush which has a rotational shaft extending in the same direction as a rotational shaft of each of the rollers which rotate the transfer belt in an endless manner, the cleaning brush having bristles implanted thereto; a collection roller which collects from the cleaning brush a foreign object which is removed from the surface of the transfer belt by the cleaning brush; and a collection roller cleaning member which is a blade-like member whose leading end comes in contact with the peripheral surface of the collection roller to remove the foreign object from the collection roller; the collection roller and collection roller cleaning member are provided in a space formed by bending the transfer belt with the bending roller at positions under the bending roller and the bending roller cleaning member on an upstream side from the bending roller and the bending roller cleaning member in the running direction of the transfer belt, and the collection section is arranged at a position to which both a foreign object removed from the bending roller by the bending roller cleaning member and a foreign object removed from the collection roller by the collection roller cleaning member fall down.

According to this invention, the collection section is arranged at a position to which both a foreign object removed from the bending roller by the bending roller cleaning member and a foreign object removed from the collection roller by the collection roller cleaning member fall down. Accordingly, a foreign object removed from the bending roller and the collection roller can be collected by one collection section without requiring a special mechanism for guiding a foreign object removed from the bending roller and the collection roller to the collection section.

Further, according to the present invention, the collection roller of the transfer unit is provided under the position at which a foreign object is removed from the bending roller by the bending roller cleaning member.

According to this invention, when a foreign object removed from the bending roller by the bending roller cleaning member falls down, the foreign object is collected directly by the collection section, or the foreign object is collected by the collection roller and thereafter removed from the collection roller by the collection roller cleaning member and then collected by the collection section. Accordingly, the cleaning mechanism configured by the bending roller cleaning member, the collection roller, the collection roller cleaning roller, and the like can be further downsized in the running direction of the transfer belt.

This application is based on Japanese Patent application serial No. 2008-021352 filed in Japan Patent Office on Jan. 31, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A transfer unit which is mounted to an apparatus main body of an image forming apparatus, the transfer unit comprising:

a transfer belt which extends between a plurality of rollers so as to be capable of running in an endless manner, the transfer belt receiving on its front surface or a recording sheet placed on the front surface a toner image which is borne on an image bearing member in accordance with image information;

a bending roller having a peripheral surface which is pressed against the front surface side of the transfer belt to bend inwardly the transfer belt which is in a state of extend between the plurality of rollers so as to be capable of running in an endless manner;

a bending roller cleaning member which cleans the peripheral surface of the bending roller;

a front surface side cleaning mechanism which cleans a front surface side of the transfer belt; and a collection section which collects a foreign object which is removed by both the bending roller cleaning member and the front surface side cleaning mechanism, wherein the front surface side cleaning mechanism includes:

a cleaning brush which has a rotational shaft extending in the same direction as a rotational shaft of each of the rollers which rotate the transfer belt in an endless manner, the cleaning brush having bristles implanted thereto;

a collection roller which collects from the cleaning brush a foreign object which is removed from the surface of the transfer belt by the cleaning brush; and a collection roller cleaning member which is a blade-like member whose leading end comes in contact with the peripheral surface of the collection roller to remove the foreign object from the collection roller;

the collection roller and collection roller cleaning member are provided in a space formed by bending the transfer belt with the bending roller on an upstream side from the bending roller and the bending roller cleaning member in the running direction of the transfer belt, a position at which the collection roller cleaning member comes in contact with the collection roller is under a position at which a foreign object is removed from the bending roller by the bending roller cleaning member, and the collection section is arranged at a position under both the position at which the collection roller cleaning member comes in contact with the collection roller and the position at which the foreign object is removed from the bending roller by the bending roller cleaning member.

2. The transfer unit according to claim 1, wherein the bending roller is a non-elastic member, and the bending roller cleaning member is a blade-like member whose end portion comes in contact with a peripheral surface of the bending roller.

3. A transfer unit which is mounted to an apparatus main body of an image forming apparatus, comprising:

a transfer belt which extends between a plurality of rollers so as to be capable of running in an endless manner, the transfer belt receiving on its front surface or a recording sheet placed on the front surface a toner image which is borne on an image bearing member in accordance with image formation;

a bending roller being a non-elastic member and having a peripheral surface which is pressed against the front surface side of the transfer belt to bend inwardly the transfer belt which is in a state of extend between the plurality of rollers so as to be capable of running in an endless manner;

a bending roller cleaning member cleans the peripheral surface of the bending roller, the bending roller cleaning member is a blade-like member whose end portion comes in contact with a peripheral surface of the bending roller;

a front surface side cleaning mechanism which cleans a front surface side of the transfer belt;

a collection section which collects a foreign object which is removed by both the bending roller cleaning member and the front surface side cleaning mechanism;

a roller drive power source which exerts a rotational drive force to the rollers between which the transfer belt extends;

a bending roller driving mechanism which exerts a rotational drive force to the bending roller; and a drive controller which controls driving of the bending roller driving mechanism, wherein the drive controller controls driving of the bending roller driving mechanism so that a running speed of the transfer belt which runs in an endless manner by rotation of the roller in accordance with a rotational drive force exerted from the roller drive power source and a peripheral speed of the bending roller which rotates in a state of being in contact with the bending roller cleaning member.

4. An image forming apparatus comprising: a transfer unit; and an apparatus main body to which the transfer unit is mounted, wherein the transfer unit includes:

a transfer belt which extends between a plurality of rollers so as to be capable of running in an endless manner, the transfer belt receiving on its front surface or a recording sheet placed on the front surface a toner image which is borne on an image bearing member in accordance with image information;

a bending roller having a peripheral surface which is pressed against the front surface side of the transfer belt to bend inwardly the transfer belt which is in a state of extend between the plurality of rollers so as to be capable of running in an endless manner;

a bending roller cleaning member which cleans the peripheral surface of the bending roller;

a front surface side cleaning mechanism which cleans a front surface side of the transfer belt; and a collection section which collects a foreign object which is removed by both the bending roller cleaning member and the front surface side cleaning mechanism, wherein the front surface side cleaning mechanism includes:

a cleaning brush which has a rotational shaft extending in the same direction as a rotational shaft of each of the rollers which rotate the transfer belt in an endless manner, the cleaning brush having bristles implanted thereto;

a collection roller which collects from the cleaning brush a foreign object which is removed from the surface of the transfer belt by the cleaning brush; and a collection roller cleaning member which is a blade-like member whose leading end comes in contact with the peripheral surface of the collection roller to remove the foreign object from the collection roller;

the collection roller and collection roller cleaning member are provided in a space formed by bending the transfer belt with the bending roller on an upstream side from the bending roller and the bending roller cleaning member in the running direction of the transfer belt, a position at which the collection roller cleaning member comes in contact with the collection roller is under a position at which a foreign object is removed from the bending roller by the bending roller cleaning member, and the collection section is arranged at a position under both the position at which the collection roller cleaning member comes in contact with the collection roller and the position at which the foreign object is removed from the bending roller by the bending roller cleaning member.

5. The image forming apparatus according to claim 4, wherein the bending roller is a non-elastic member, and the bending roller cleaning member is a blade-like member whose end portion comes in contact with a peripheral surface of the bending roller.

6. An image forming apparatus comprising: a transfer unit; and an apparatus main body to which the transfer unit is mounted, wherein the transfer unit includes:

a transfer belt which extends between a plurality of rollers so as to be capable of running in an endless manner, the transfer belt receiving on its front surface or a recording sheet placed on the front surface a toner image which is borne on an image bearing member in accordance with image information;

a bending roller being a non-elastic member and having a peripheral surface which is pressed against the front surface side of the transfer belt to bend inwardly the transfer belt which is in a state of extend between the plurality of rollers so as to be capable of running in an endless manner;

a bending roller cleaning member cleans the peripheral surface of the bending roller, the bending roller cleaning member is a blade-like member whose end portion comes in contact with a peripheral surface of the bending roller;

a front surface side cleaning mechanism which cleans a front surface side of the transfer belt;

a collection section which collects a foreign object which is removed by both the bending roller cleaning member and the front surface side cleaning mechanism;

a roller drive power source which exerts a rotational drive force to the rollers between which the transfer belt extends;

a bending roller driving mechanism which exerts a rotational drive force to the bending roller; and a drive controller which controls driving of the bending roller driving mechanism, wherein the drive controller controls driving of the bending roller driving mechanism so that a running speed of the transfer belt which runs in an endless manner by rotation of the roller in accordance with a rotational drive force exerted from the roller drive power source and a peripheral speed of the bending roller which rotates in a state of being in contact with the bending roller cleaning member.

* * * * *